United States Patent [19]

Spalt et al.

[11] Patent Number: 5,072,808

[45] Date of Patent: Dec. 17, 1991

[54] LADDER ADAPTABLE PLATFORM

[76] Inventors: Gregory P. Spalt; Taylor E. Spalt, both of 8 Redgate La., Cohasset, Mass. 02025

[21] Appl. No.: 636,071

[22] Filed: Dec. 28, 1990

[51] Int. Cl.[5] ..... E04C 1/38; E04C 7/16

[52] U.S. Cl. ..... 182/103; 182/120

[58] Field of Search ..... 182/103, 120, 121, 122; 248/210, 235

[56] References Cited

U.S. PATENT DOCUMENTS

| | | | |
|---|---|---|---|
| 444,280 | 1/1891 | Pepin | 182/103 |
| 651,665 | 6/1900 | Johns | 182/103 |
| 715,944 | 12/1902 | Bauer | 182/103 |
| 1,820,315 | 8/1931 | Miller | 182/122 |
| 2,486,783 | 11/1949 | Hartman . | |
| 2,899,011 | 8/1959 | Babits . | |
| 2,945,549 | 7/1960 | Gagnon . | |
| 3,067,836 | 12/1962 | Carnicelli . | |
| 3,078,950 | 2/1963 | Schramm | 182/120 |
| 3,115,214 | 12/1963 | Roberts . | |
| 3,760,902 | 9/1973 | Nyman | 182/103 |
| 3,910,378 | 10/1975 | Nyman | 182/103 |
| 4,586,586 | 5/1986 | Canals . | |
| 4,800,988 | 1/1989 | Dunmore | 182/103 |
| 4,911,265 | 3/1990 | Skaggs . | |

*Primary Examiner*—Reinaldo P. Machado
*Attorney, Agent, or Firm*—Don Halgren

[57] ABSTRACT

A ladder adaptable platform for attachment to a typical extension ladder which has a pair of parallel side rails and spaced rungs. The ladder adaptable platform has a platform surface which is engageable at the backside of a desired rung, the platform surface having side frames which each articulably support rail engaging channels. The ladder adaptable platform may be moved up or down the ladder by lifting the platform from engagement with its rung, sliding the channels up or down the ladder rails to a new desired rung to which the platform surface may be engaged.

15 Claims, 2 Drawing Sheets

LADDER ADAPTABLE PLATFORM

BACKGROUND OF THE INVENTION

1. Field of the Invention

This invention relates to ladders and more particularly to devices for ladders so as to provide an adjustable broader step thereon.

2. Prior Art

There are several different types of extension ladders. Initially they were made of wood, but more recently extension ladders have been made of aluminum or fiberglass. These extension ladders are inherently difficult to stand on for any extended period of time. The newer extension ladders however may have thereacross rungs made into a "D"-shape, in cross section, wherein a flattened side may be disposed across the upper surface thereof. Nonetheless, it is very tiring for a users leg, to be standing with ones feet disposed across the rung by itself.

The prior art contains a number of patents all of which have a fault wherein the platform upon which the user may place his feet, extends either in front of the rung, or immediately over it, presenting a potential hazard by which the user may trip. For example, U.S. Pat. No. 1,820,315 to Miller shows a step attachment for ladders with a platform which hangs off of the rung, and in front thereof.

U.S. Pat. No. 2,486,783 to Hartman et al shows a platform attachment for rung type ladders also is disposed upon the front side of the ladder and over the rung. And the platform itself raises the tread for the user above the rung. This could be dangerous in as much as the user might inadvertently miss that spot.

U.S. Pat. No. 2,899,011 to Babits shows a ladder step, with a pair of flaps which extend around behind the ladder rails, with fingers which also are disposed around the front side of the ladder rung. A platform portion extends out in front of each rung. Again this is inherently dangerous as the user may trip thereover.

U.S. Pat. No. 3,067,836 to Carnicelli shows an adjustable platform step for extension ladders, again disposed both above the rung and out in front of it. The platform means has a complicated locking device to secure it to the rung, and has an adjustable platform to compensate for the angle of the ladder.

U.S. Pat. No. 3,115,214 to Roberts shows a portable step attachment for extension ladders which hang out in front of the ladder and is secured to a rung thereon. This platform has a central portion which is swingable up and out of the way to permit the user some access therearound. Roberts thereby acknowledges the difficulty with getting over a platform on a ladder, however he fails to deal with the inherent problem of having the platform in front of the ladder rung.

U.S. Pat. No. 4,586,586 to Canals shows a work step for an extension ladder having a platform which is articulable about a rung thereadjacent. The platform has a complicated locking mechanism in which the platform may be held parallel to the side frame of the ladder. The platform extends onto the rung of the ladder and extends slightly forward of it.

Lastly, there is U.S. Pat. No. 4,911,265 to Skaggs showing a ladder platform with a rung securing mechanism having a rather complicated locking mechanism which holds the platform onto the next highest rung.

The platform extends out beyond the forward face of the frame of the ladder.

None of the art appears to present an articulable, easily moveable ladder platform which is arranged so as to present a tread surface behind the ladder rung, which surface does not get in the way of one moving up or down the ladder.

It is therefore an object of the present invention to provide a ladder adaptable platform which is functional and not hazardous to the user thereof.

It is a further object of the present invention to provide a ladder adaptable platform which is easily adapted to a ladder, and which is convenient and safe to utilize.

BRIEF SUMMARY OF THE INVENTION

The present invention comprises a ladder adaptable platform having a foot supporting generally planar platform surface, which extends almost the length of a rung of a typical extension ladder. The planar platform surface, has secured at each longitudinal end thereof, an upstanding frame portion and downwardly directed lips. Each frame portion has a forward, generally rearwardly sloping edge. Each frame portion has a rearward edge, generally normal to the platform surface, meeting the forward edge at an apex.

A finger extends downwardly from the lowermost front of the forward edge, creating an upside-down "U" between the finger and the front lip of the planar platform surface.

Each rearward edge has an "L"-shaped member extending outwardly thereof, as guiding means. Each "L"-shaped member extends about half the length of the rearward edge of each frame portion. The "L"-shaped members, which may be an extrusion, have a rearward planar portion and a side planar portion, the pair of which comprise the "L"-shaped configuration.

Each side planar portion has a longitudinally directed cut out therein, which function as handles, to permit a platform user to adjust it on the ladder during utilization thereof.

A shaft is disposed across the frame portions, adjacent the apexes. The shaft is threaded, at least at the ends, which extend beyond the respective outer sides of the frame portions.

A ladder slider, comprised of a "U" or channel shaped member, which has a ferrule secured to its intermediate section.

The ferrule receives the shaft therethrough, the shaft having a nut or other adjustable securement means thereon, so as to keep the ladder sliders on the shaft.

Each ladder slider has a lower end and an upper end. A spring or other biasing means is arranged between an opening in the rearward planar portion of the "L"-shaped member, and the lower end of the ladder slider.

In the use of the platform adapter, on an extension ladder, the ladder adaptable platform is put onto the backside of the ladder before the ladder is raised into its "use" position.

The typical extension ladder is constructed of a pair of parallel side rails connected by a plurality of spaced apart, parallel rungs. In the popular aluminum ladders, the side rails are either channel (U) shaped or "I"-shaped. In either case, the ladder slider is mated over the rearward sidewardly directed edge (lip/flange) of each side rail. The adjustable securement means may be tightened to bring each ladder slide into slidable, yet fitting engagement with those edges of their respective rails.

The ladder user may then grasp the side portions, by each of the handles or cutouts, and slide the ladder adaptable platform to the desired location on the ladder.

The downwardly projecting finger at the lowermost forward edge of each side planar portion is articulated over the particular rung chosen. The inverted "U" configuration serves as a rung locking means for the ladder adapter platform.

The spring arranged between the lower end of the ladder slide and the rearward planar portion acts to pull (biased) the ladder adapter platform about the axis of the shaft, and towards the ladder.

When it is desired to move the ladder adapter platform from one rung to another rung, the user merely steps down off of the platform, engages the side cutout portions or handles, and lifts the downwardly directed fingers up and over the rung, against the biasing force of the springs, and moves the ladder adapter platform upwardly or downwardly to the next desired rung position, and engages the extended downwardly directed fingers of the side planar portions thereover.

It is to be noted that the ladder adapter platform may be constructed of sheet metal or plastic, or like extrusion and that the ladder slide may have an opening across the channel component thereof, large enough to engage a solid wood or fiberglass ladder or the like.

The foot supporting platform surface has an upper surface which is generally coplanar with the upper edge of any rung on which it is to be mated. The foot supporting platform surface may have anti-slip means such as surface irregularities, to help prevent slippage by a user thereon.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENTS

Figure 1:
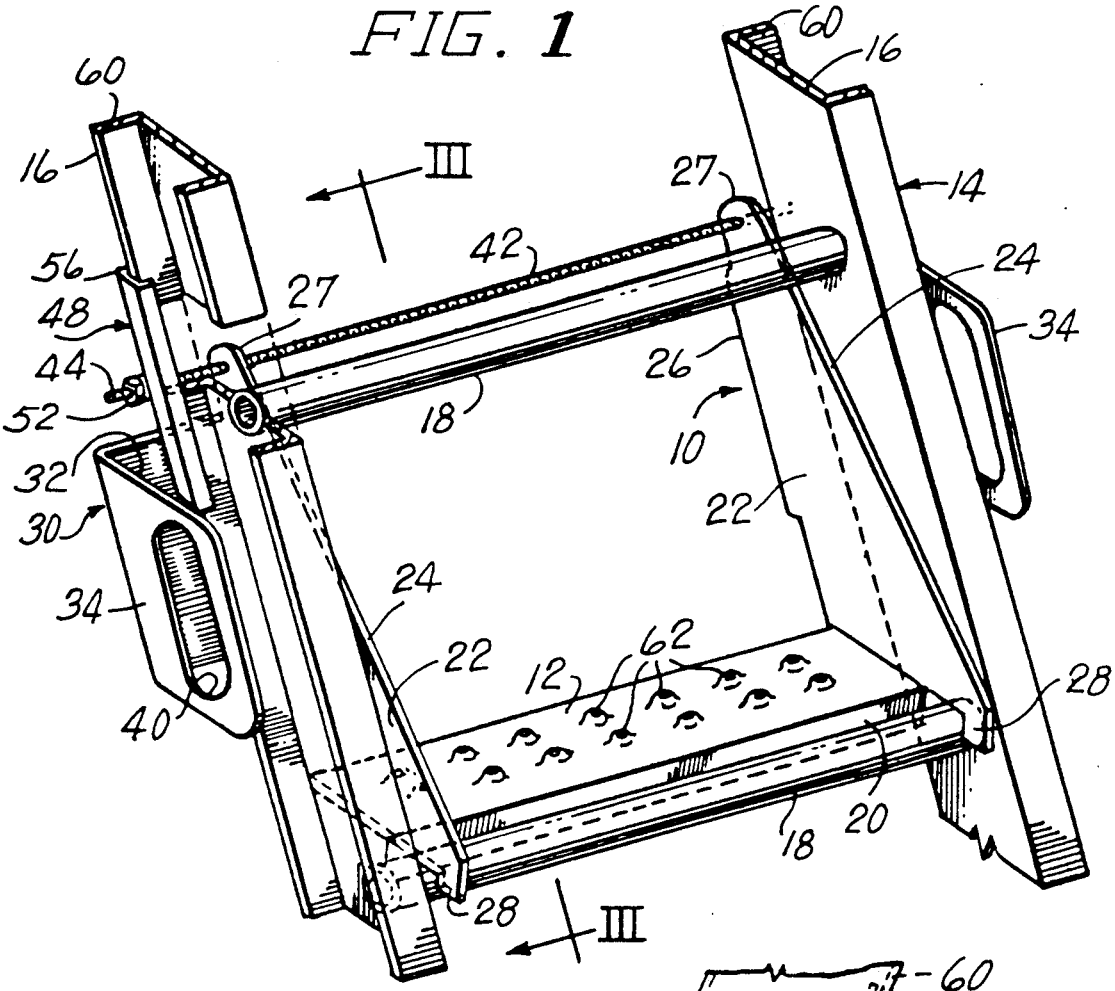
FIG. 1 is a partial perspective view of a ladder adapter platform shown on a portion of an extension ladder.

Referring to the drawings in detail and particularly to FIG. 1, there is shown a ladder adaptable platform 10 having a generally planar platform surface 12. The platform surface 12 is shown arranged with respect to a portion of an extension ladder 14. Extension ladders typically are comprised of two parallel side rails 16, with a plurality of spaced apart rungs 18. The platform surface 12 is not quite as long as the length of a rung 18.

The platform surface 12 has a downwardly dispoed lip 20 along each longitudinal edge thereof. An upstanding frame portion 22 is arranged at each end of the platform surface 12. Each frame portion 22 has a forward edge 24 which slopes generally rearwardly. Each frame portion 22 also has a rearward edge 26, generally normal to the platform surface 12, and which meets the forward edge 24, at an apex 27.

A finger 28 extends downwardly from the lowermost front portion of the forward edge 24 of each frame portion 22. An inverted "U" is created between each finger 28 and the front lip 20 adjacent the platform surface 12 as may be seen in FIGS. 2 and 3. This inverted "U" acts as a securement means for the platform surface 12 with respect to its corresponding rung 18.

Figure 3:
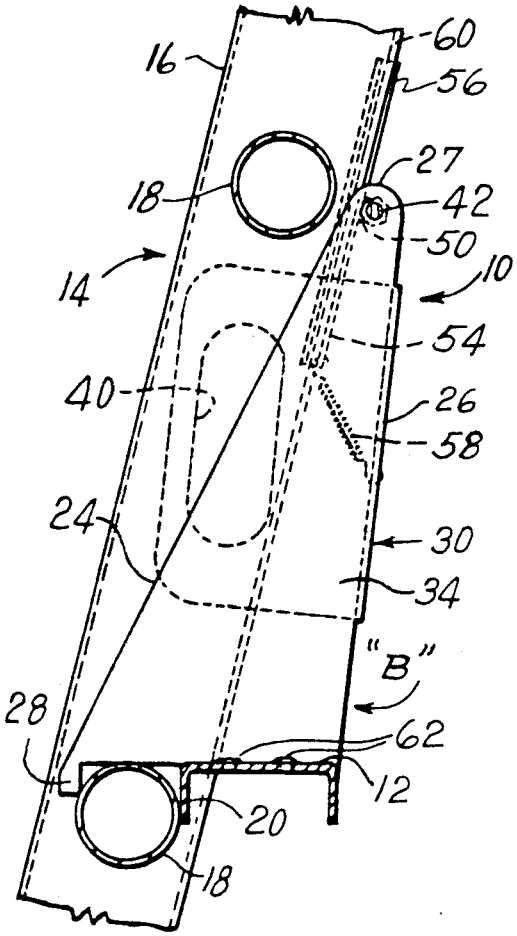
FIG. 3 is a side elevational view of a ladder adapter platform engaging a rung on a ladder, taken along the lines III—III of FIG. 1.
Figure 4:
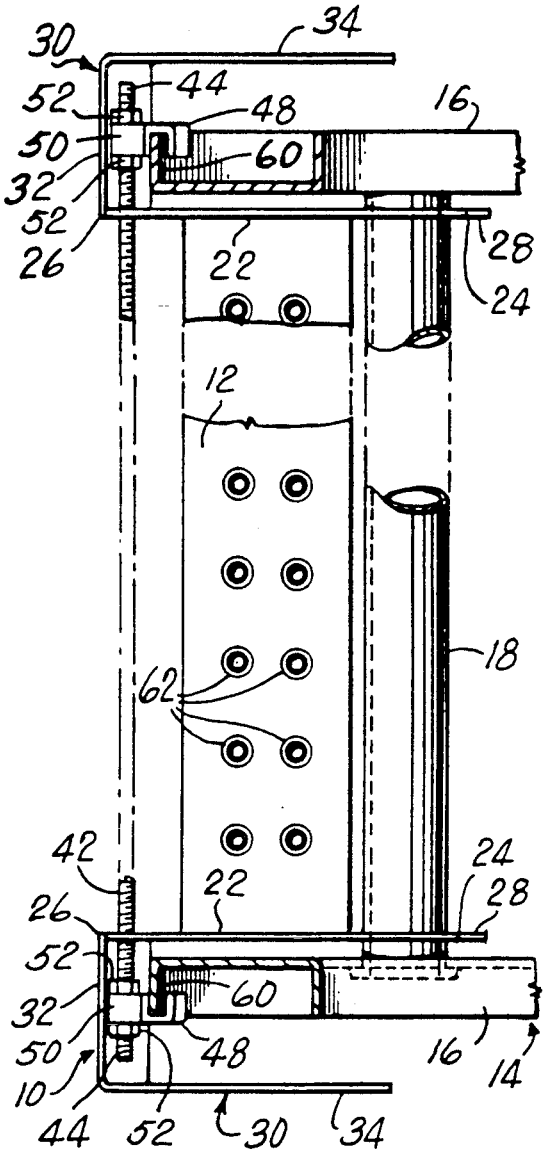
FIG. 4 is a plan view of a ladder adapter platform engaged with the side rails of an extension ladder.
Figure 5:
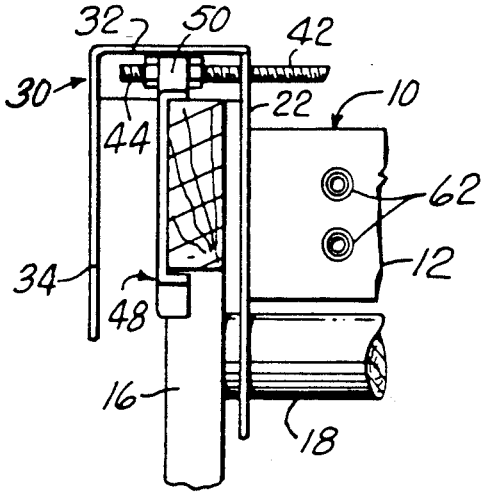
FIG. 5 is a plan view of one side of a ladder adapter platform engaging the side rail of a wooden type extension ladder.

Each rearward edge 26 has an "L"-shaped frame 30 extending outwardly at the side thereof, as may best be seen in FIGS. 4 and 5. Each "L"-shaped frame member 30, which may be an extrusion, preferably which may be an extrusion, preferably has a length of about at least one-half the rearward edge 26 of the frame portion 22 as may be seen in FIGS. 2 and 3 and defines a handle for moving the platform ID. Each "L"-shaped frame member 30 has a rearward planar portion 32 which extends generally parallel to the rungs 18 of a ladder there arranged, and extending forwardly from the outward edge of each rearward planar portion 32, is a side planar portion 34, as seen best in FIGS. 1, 4 and 5.

An elongated cutout 40 is disposed in each side planar portion 34, near its forwardmost distal edge, as shown in FIG. 1. The cutouts 40 permit a user to manually grip the ladder adjustable platform 10 to move it up or down on a ladder. It is to be noted that the frame member 30 could be comprised of tubular components, not shown, to function as a peripheral frame-like handle.

A shaft 42 is disposed across the frame portions 22, at their apexes 27, as shown in FIG. 1. The shaft 42 is preferably threaded, at least at its ends 44, which extend their respective outer sides of the frame portions 22.

Figure 2:
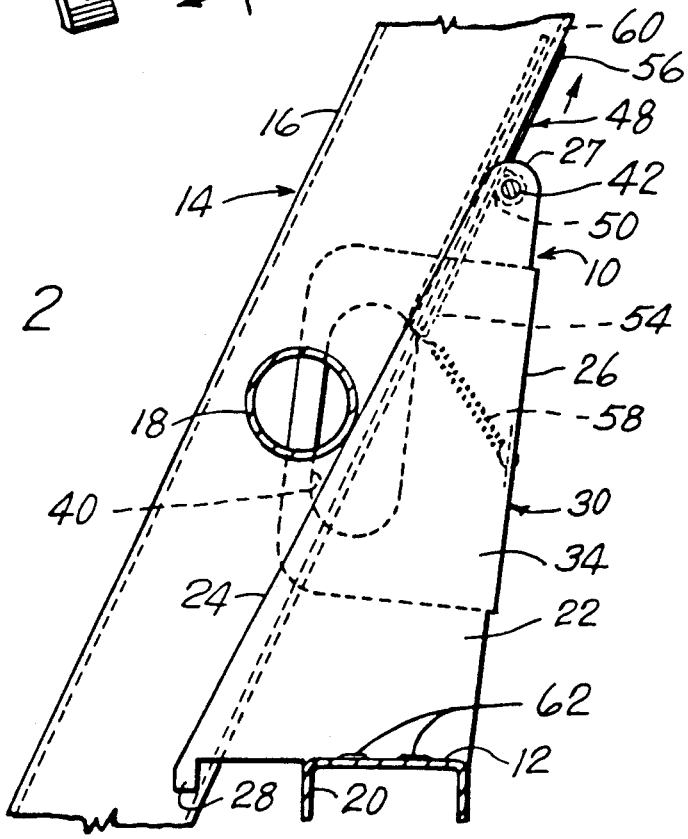
FIG. 2 is a side elevational view in section of a ladder adapter platform between supportive rungs.

A ladder slider 48, comprised of a "U" or channel shaped member, has a ferrule 50 on the back side thereof, welded or otherwise integral therewith at a midpoint thereof, as shown partially in FIGS. 2 and 3, and more clearly in FIGS. 4 and 5. Each ferrule 50 receives one end of the shaft 42 therethrough. The shaft 42 has a nut arrangement 52 or other adjustable securement means thereon, so as to adjustably hold the ladder slides 48 on the ends of the shaft 42.

The ladder slider 48 has a lower end 54 and an upper end 56. A spring 58 or other biasing means is arranged between the lower end 54 of the ladder slider 48, and an opening not shonn, in the rearward planar portion 32, into which it hooks. This is best shown in FIGS. 2 and 3.

In operation of the ladder adaptable platform 10 on an extension type ladder 14, the ladder adaptable platform 10 is preferably slid onto the backside of the ladder before the ladder is raised into its "use" position.

In the typical "aluminum" type ladder, exemplifed by FIGS. 1, 2, 3 and 4, the side rails 16 have an "I" beam construction or a "channel" construction, in either case, having an outwardly directed rear lip/flange 60. The ladder slider 48 is mated over the lip/flange 60 as shown in figures 1 and 4. The nuts 52 may be threadably adjusted to limit sideways movement of the ladder sliders 48 on the shaft 42, while still permitting a sliding relationship between the ladder slider 48 and the side rails 16.

A user of the ladder adaptable platform 10 may then grasp the "handle", that is the side planar portions 34 by the cutouts 40, and slide the ladder adaptable platform 10 up or down to the desired location on the ladder 16. The side view shown in FIG. 2 shows the ladder adaptable platform 10 not yet secured to any particular rung 18.

The side view shown in FIG. 3 shows the downwardly projecting finger 28 at the lowermost forward edge 24 of one side frame portion 22, mated over a particular rung 18. This inverted "U" serves as a rung locking means to secure the platform surface 12 juxtaposed in a common plane with the top of the rung 18.

The spring 58 arranged between the lower end 54 of the ladder slider 48 and the rearward planar portion 32 acts to pull (bias) the ladder adapter platform 10 about its shaft 42 and towards the ladder 16, as indicated by the arrow "B", shown in FIG. 3.

To move the ladder adapter platform 10 upwardly or downwardly to another desired rung !8 on the ladder 16, the user merely steps down from the ladder adapter platform 10 to a lower rung 18, disengages the fingers 28 from their overlapping of their rung 18, and presses the lower portion of the ladder adapter platform 10 away from the ladder, against the biasing of the spring 58, and slides the ladder sliders 48 upwardly or downwardly, as desried, on the lip/flanges 60, to engage the fingers 28 in an overlapping relation to the next rung 18.

In the embodiment of the portion of the ladder adapter platform 10 shown in FIG. 5, the ladder sliders 48 are shown still channel or "U" shaped, but of a wider dimension sufficient to engage (or wrap half-way around) a solid wooden (or fiberglass) rail 16.

The platform surface 12 may have irregularities such as dimples 62, or the like, thereon, to assist in traction of a user's shoes thereon.

Thus, what has been shown and described is a novel, inexpensive, portable easily manufactured and easily adjustable platform adatpable to assist users of extension ladders.

I claim:

1. A ladder adaptable platform for use on an extension ladder, the extension ladder having a pair of parallel side rails and spaced rungs, to provide a stepping surface in alignment with a rung of the extension ladder, said ladder adaptable platform comprising:

a platform surface arrangeable adjacent to the backside of a rung, and releaseable securable thereto;

an arrangement of side frame members secured to said platform surface; and articulable engagement means attached to the side frame members, to engage the rails of an extension ladder, and which are moveable with respect thereto.

2. The ladder adaptable platform as recited in claim 1, wherein said articulable enagement means have a biasing means therewith, to bias said platform surface towards a ladder to which said ladder adaptable platform is attached.

3. The ladder adaptable platform as recited in claim 2, wherein said side frame members each have a handle means arranged thereon.

4. The ladder adaptable platform as recited in claim 3, wherein said handles comprise an arrangement of panels which extend partway around the back and side of the rails of a ladder.

5. The ladder adaptable platform as recited in claim 3, wherein said panels have a cutout therein to facilitate adjustable movement of said ladder adaptable platform from one rung of a ladder to another rung thereof.

6. The ladder adaptable platform as recited in claim 2, wherein said articulable engagement means comprises at least one elongated channel shaped member to articulably engage at least one rail of a ladder.

7. The ladder adaptable platform as recited in claim 5, wherein said frame members have a shaft extending therebetween, said shaft supporting said channel shaped members to said frame members, said channel shaped members securing a portion of said ladder adaptable platform to a ladder there associated.

8. The ladder adaptable platform as recited in claim 6, wherein adjustable securement means secures said channel shaped members to said shaft.

9. A ladder adaptable platform to provide a broad stepping surface on an extension ladder having parallel side , rails and rings, for attachment to the backside of a rung, said platform comprising;

a platform surface;

a rung engagement means adjacent said platform surface to secure said surface and said ladder adaptable platform to a rung;

a pair of frame portions supporting said platform surface; and biased articulable engaging means to secure said frame portions to said rails of an extension ladder.

10. A ladder adaptable platform as recited in claim 8, wherein said rung engaging means comprise a downwardly directed finger projectable about a portion of a rung so as to hold said platform surface thereadjacent.

11. A ladder adaptable platform as recited in claim 9, wherein said downwardly directed finger and said platform surface define an inverted U shape between them, which shape wraps over a rung to which it is secured.

12. A ladder adaptable platform as recited in claim 10, wherein said engaging means is biased by a spring means arranged between said engaging means and a portion of said frame means.

13. A ladder adaptable platform as recited in claim 10 including a shaft which extends transversely between said frame portions, said engagement means being pivotable in said shaft.

14. A ladder adaptable platform as recited in claim 12, wherein a ferrule is attached to said engagement means for moveable mating with said shaft.

15. A ladder adaptable platform as recited in claim 14, wherein said engagement means comprises a channel shaped member which engages the side rails of a ladder in an adjustable sliding relationship.

* * * * *